US009681728B2

(12) United States Patent
Jung

(10) Patent No.: US 9,681,728 B2
(45) Date of Patent: Jun. 20, 2017

(54) TUBE CONTAINER WITH A METAL APPLICATOR

(71) Applicant: YONWOO CO., LTD., Incheon (KR)

(72) Inventor: Seo-Hui Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 55 days.

(21) Appl. No.: 14/759,348

(22) PCT Filed: Oct. 28, 2014

(86) PCT No.: PCT/KR2014/010154
§ 371 (c)(1),
(2) Date: Jul. 6, 2015

(87) PCT Pub. No.: WO2016/060313
PCT Pub. Date: Apr. 21, 2016

(65) Prior Publication Data

US 2016/0249726 A1 Sep. 1, 2016

(30) Foreign Application Priority Data

Oct. 16, 2014 (KR) ..... 10-2014-0139961

(51) Int. Cl.

| | |
|---|---|
| ***A45D 34/04*** | (2006.01) |
| ***B65D 35/02*** | (2006.01) |
| ***B65D 35/36*** | (2006.01) |
| ***B65D 35/44*** | (2006.01) |
| ***B65D 35/10*** | (2006.01) |
| ***B65D 35/38*** | (2006.01) |
| ***B65D 41/16*** | (2006.01) |

(52) U.S. Cl.
CPC ..... *A45D 34/04* (2013.01); *B65D 35/02* (2013.01); *B65D 35/10* (2013.01); *B65D 35/36* (2013.01); *B65D 35/38* (2013.01); *B65D 35/44* (2013.01); *B65D 41/165* (2013.01); *A45D 2200/15* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,883,287 B2 * | 2/2011 | Thorpe | ..... | A45D 34/04 401/265 |
| 2008/0142036 A1 * | 6/2008 | Sanchez | ..... | A45D 34/04 132/320 |

* cited by examiner

*Primary Examiner* — David Walczak
(74) *Attorney, Agent, or Firm* — Marshall, Gerstein & Borun LLP

(57) ABSTRACT

A tube container with a metal applicator, and more particularly, a tube container equipped with a metal applicator which is attached on the top portion of the tube container, so that when contents are applied onto the skin it is possible for the metal applicator to deliver heat or cold to the skin and facilitate metabolism of the facial skin, improving the elasticity of the skin.

4 Claims, 6 Drawing Sheets

TUBE CONTAINER WITH A METAL APPLICATOR

CROSS-REFERENCE TO RELATED APPLICATIONS

This U.S. non-provisional patent application is a national stage application under 35 U.S.C. §371 of international application PCT/KR2014/010154, filed Oct. 28, 2014, and claims the benefit of priority under 35 U.S.C. §119 of Korean Patent Application No. 10-2014-0139961, filed Oct. 16, 2014, the entire contents of which are hereby incorporated herein by reference for all purposes.

TECHNICAL FIELD

The present disclosure relates to a tube container equipped with a metal applicator, and more particularly, a tube container equipped with a metal applicator which is attached on the top portion of the tube container, so that when contents are applied onto the skin it is possible for the metal applicator to deliver heat or cold to the skin and facilitate metabolism of the facial skin, as improving its elasticity.

BACKGROUND OF THE DISCLOSURE

Generally, a tube container comprises a tube body containing contents, a tube neck comprising an outlet part that is coupled to an upper portion of the tube body, as supporting the tube body and allowing the contents contained in the tube body to be discharged into, and an overcap that is coupled detachably to the tube neck and opens and closes the outlet part.

The tube containers as above, wherein contents are discharged through the outlet part when the tube container is pressurized, as shown in FIG. 1 of patent registration no. 10-1057333, has an applicator, which is coupled to a tube upper structure (120), like a brush (140) which sucks contents and discharges to the outside to allow contents to be applied easily over the skin.

Recently, as interest in skincare increases, it is hard to obtain satisfying absorbance and skincare effect only by absorbing the contents, so that there have been tried a variety of methods that can apply heat or cold onto a face in order to facilitate metabolism of the facial skin and improve its elasticity; however, the said registered patent has a structure wherein contents are sucked from the contain body and discharged through the brush (140), and thus it is hard for heat or coldness to be delivered onto the facial skin.

Meanwhile, to satisfy customers' need such as the described above, hot and cold maskpack devices for serving as hot or cold maskpack are manufactured and released commercially. However, since the structure of these products is complicated and thereby manufacturing cost is high, they are not widely utilized.

Accordingly, a simple structured cosmetic container is needed that can deliver heat or cold onto the skin when the contents is applied.

Meanwhile, the applicator that can deliver heat or cold onto the skin when applying the contents are usually made of metal, while a support body that supports the applicator is usually made of thermoplastic resin; however, there is a big gap in the deformation rate against temperature change between metal and thermoplastic resin, and the coupling structure of two parts becomes loose or separated, leading to a problem that contents may be licked through an opening.

SUMMARY OF THE DISCLOSURE

The presently disclosed embodiments are devised to solve the problems above, with the goal of equipping a metal applicator, which will be contacted to the skin, on the top of a tube container, so that when the contents are applied onto the skin, it is possible to deliver heat or cold onto facial skin, leading to facilitating the metabolism of the facial skin and improving its elasticity.

Furthermore, the present disclosure is related to a tube container equipped with a metal applicator that is manufactured in the circular shape through NC manufacturing process and is able to be attached and detached on the top of the support body, thereby possible to lower manufacturing cost and also to mass-produce due to no need of a separate mold for producing an applicator.

Meanwhile, there is a task to be solved, which is to make the strong bond between the applicator and the support body, even though the metal applicator and the support body made of thermoplastic resin change differently in size according to temperature change.

To solve the above problems, a tube container equipped with a metal applicator according to the presently disclosed embodiments comprise a tube body 100 which contains contents inside and on whose top a tube neck 110 is combined in order for contents to be discharged; a support body 200, made of thermoplastic resin, which is combined to the top of the said tube neck and forms a passage wherein contents moves through the outlet part 111; a metal applicator which is combined on the top of the tube neck 110 with insertion combination; and an overcap 400, encircling the support body 200 and the applicator 300 and combined to the tube neck 110, which comprises an opening and closing projection 410 that opens and closes a content discharging hole 310 of its inside.

The said support body 200 comprises a fixing part 210 which fixes the support body to the tube neck 110, while encircling the outlet part 111 on the inner lower portion of the support body 200 and combined to the tube neck 110; a contents movement tube 220 connected with the outlet part 111 and forming a passage wherein contents discharged through the outlet part 111 flows in; a coupling part 230 built on the upper end with protrusion and coupled with the applicator 300, wherein a securing protrusion 231 is formed, encircling the outer circumferential surface for the applicator 300 to be secured; and a hollow part 240 which is formed from the upper portion to the lower portion of the support body 200.

The applicator 300 comprises a depression coupling part 320, wherein the securing protrusion 231 is inserted and combined to the lower side of the applicator 300, and a coupling protrusion 330 which forms along the inner circumferential surface in order for the securing protrusion 231 to secure on the lower side of the depression coupling part 320.

The outer radius of the coupling part 230 under the lowest usable temperature is the same or bigger than the inner radius of the depression coupling part 320 under the ordinary usable temperature.

Furthermore, on the lower portion of outer circumferential surface of the outlet part 111 is formed a rotation preventing protrusion 111*b* which couples with the support body 200 and simultaneously prevents the rotation thereof.

Furthermore, on the lower end of the fixing part 210 is formed a coupling groove 211 which is coupled with the rotation preventing protrusion 111*b*.

Furthermore, on the outlet part 111 is formed a fixing protrusion 111*c* which encircles the outer circumferential surface to prevent the support body 200 from being separated upward, and a protrusion 212 which meets the lower end of the fixing protrusion 111*c* is formed on the lower inner portion of the fixing part 210.

According to the present disclosure as described above, the present embodiments have an advantage in that, when applied on the face, by equipping on the tube container a metal applicator contacted onto facial skin, it is possible to apply heat or cold and thereby to facilitate its metabolism and improve its elasticity.

Furthermore, through NC manufacturing process, by manufacturing a metal applicator into a circular shape that can be attached and separated on the upper portion of the support body, the presently described embodiments do not need a separate mold to build an applicator; therefore, it is possible to reduce manufacturing cost and also to mass-produce in a short time.

In addition, in the metal applicator and the support body that are coupled by the hollow part with elastic insertion combination, despite the difference of the size change of the metal applicator and the support body which is thermoplastic resin, the strong combination between the metal applicator and the support body is still possible.

DETAILED DESCRIPTION

Figure 1:
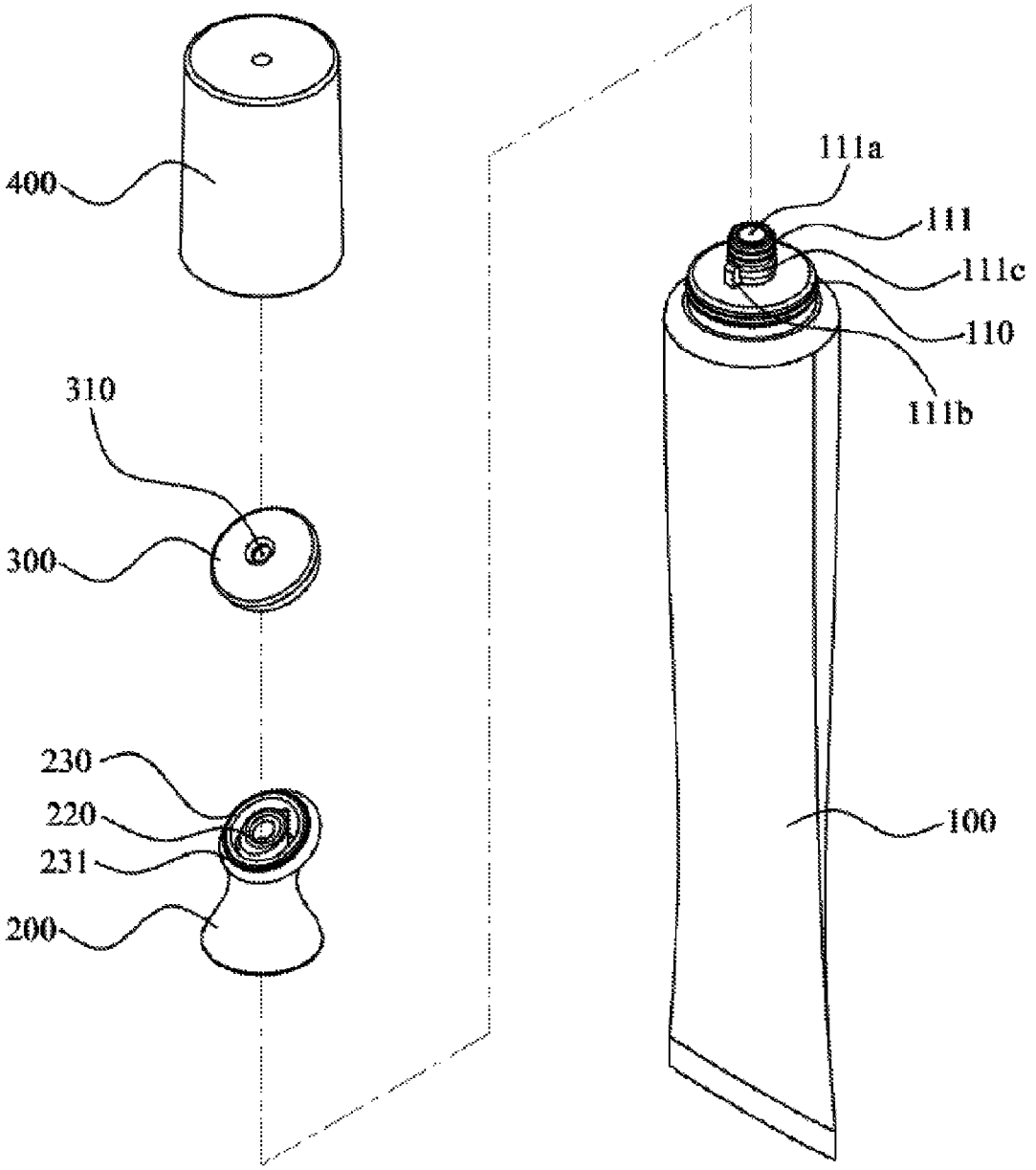
FIG. 1 is a exploded perspective view illustrating a configuration of a tube container equipped with a metal applicator according to an exemplary embodiment of the present disclosure.

Hereinafter, exemplary embodiments will be described in detail with reference to the accompanying drawings. The same reference numerals provided in the drawings indicate the same members.

Figure 2:
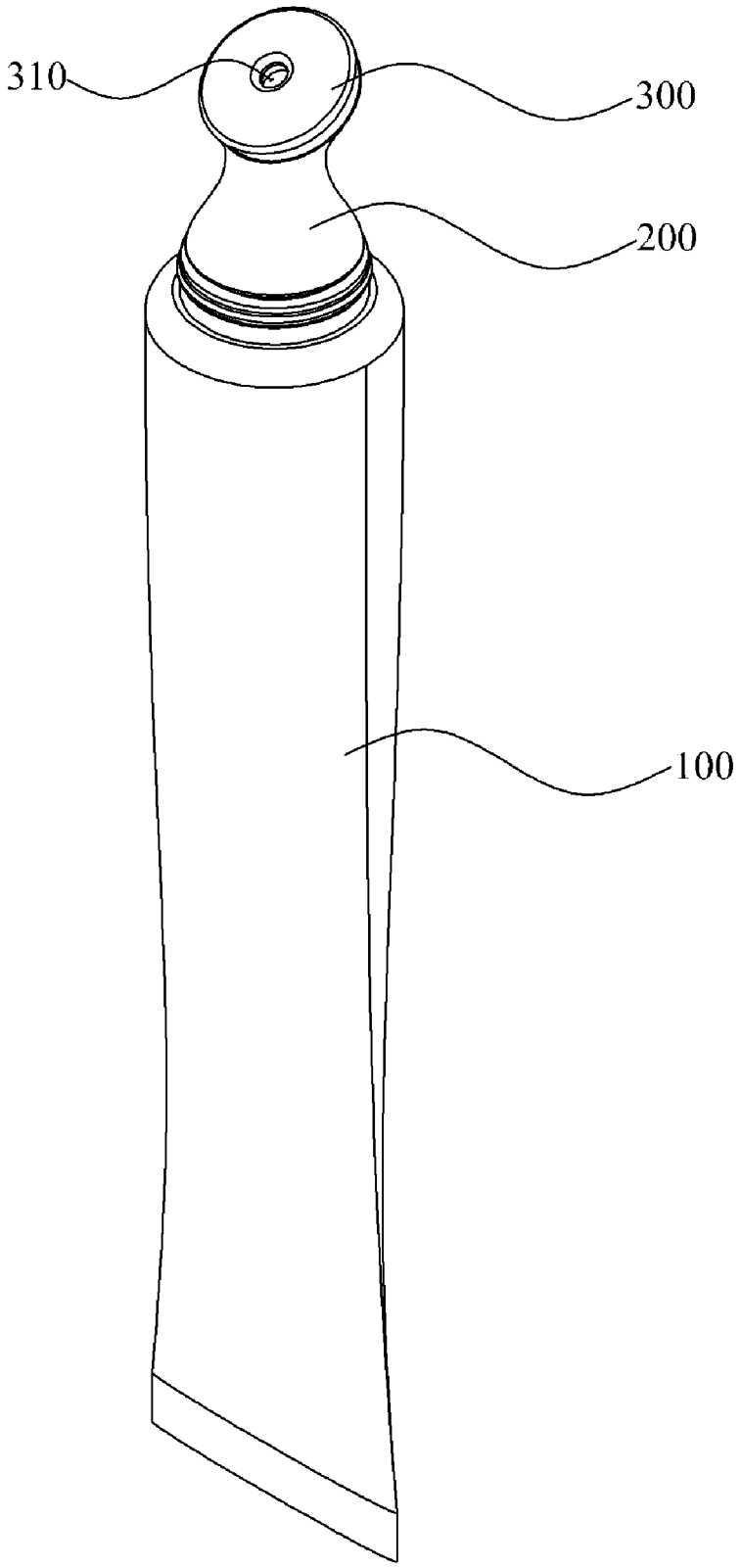
FIG. 2 is an assembled perspective view illustrating a configuration of a tube container equipped with a metal applicator according to an exemplary embodiment of the present disclosure.

FIG. 1 is an exploded perspective view illustrating a configuration of a tube container equipped with a metal applicator according to an exemplary embodiment of the present disclosure. FIG. 2 is an assembled perspective view illustrating a configuration of a tube container equipped with a metal applicator according to an exemplary embodiment of the present disclosure.

Figure 3:
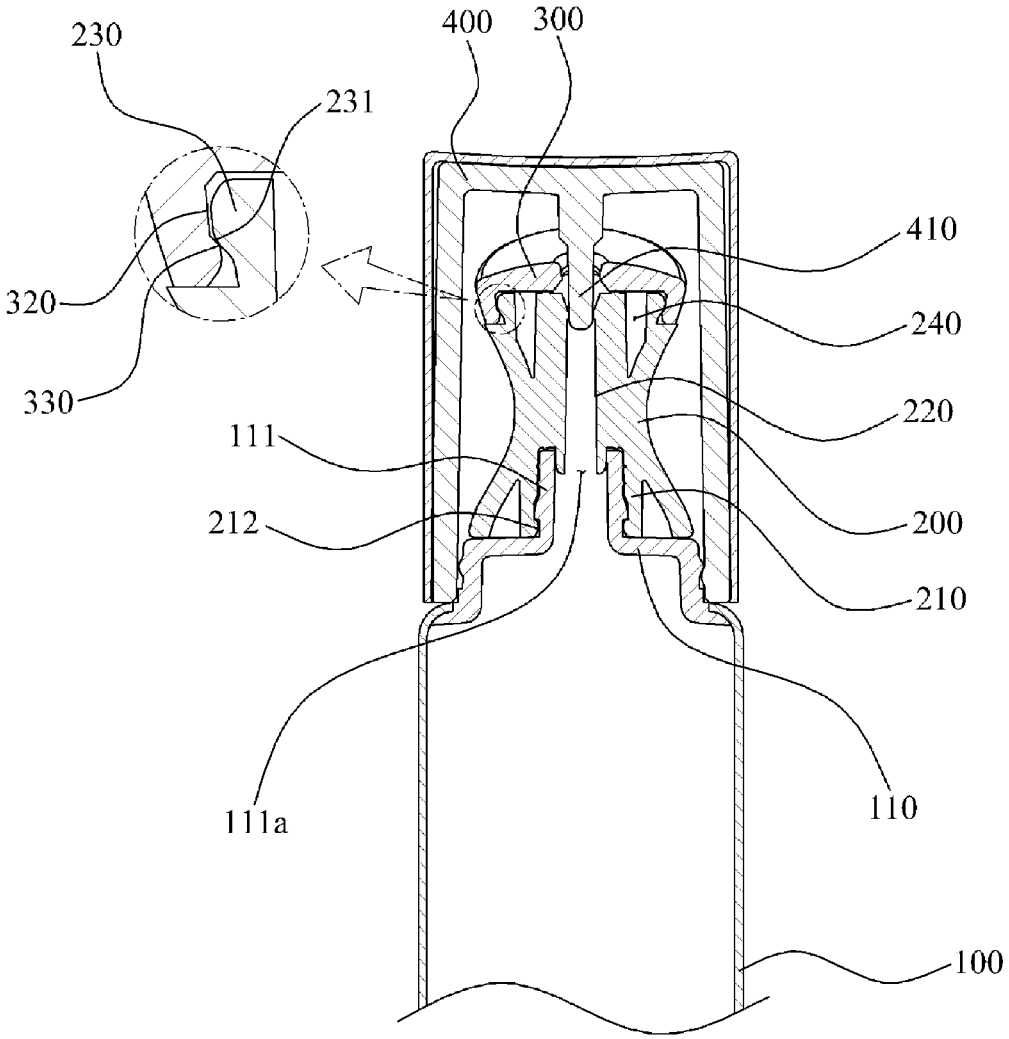
FIGS. 3 and 4 are cross-sectional views illustrating a configuration of a tube container equipped with a metal applicator according to an exemplary embodiment of the present disclosure.
Figure 4:
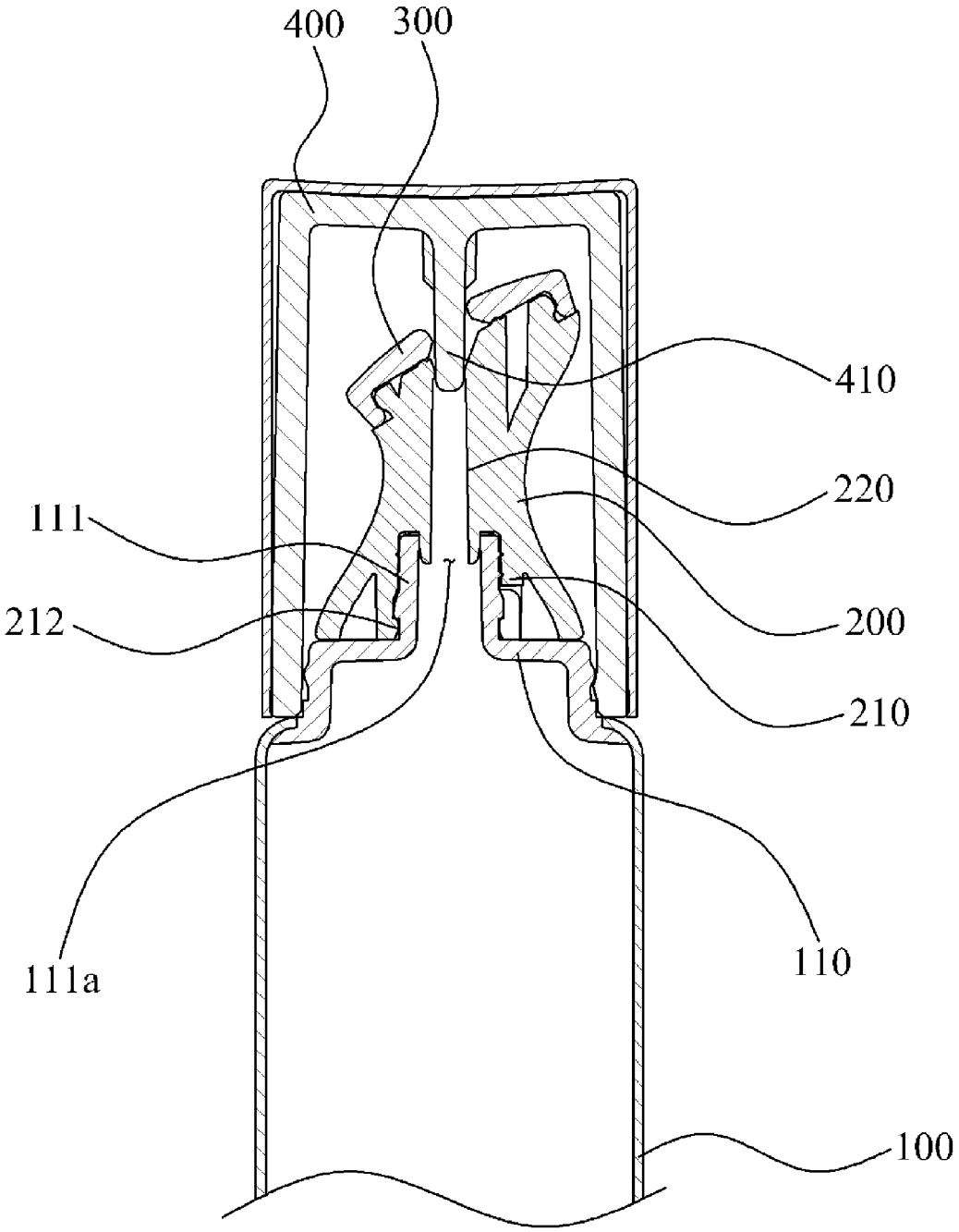
Figure 5:
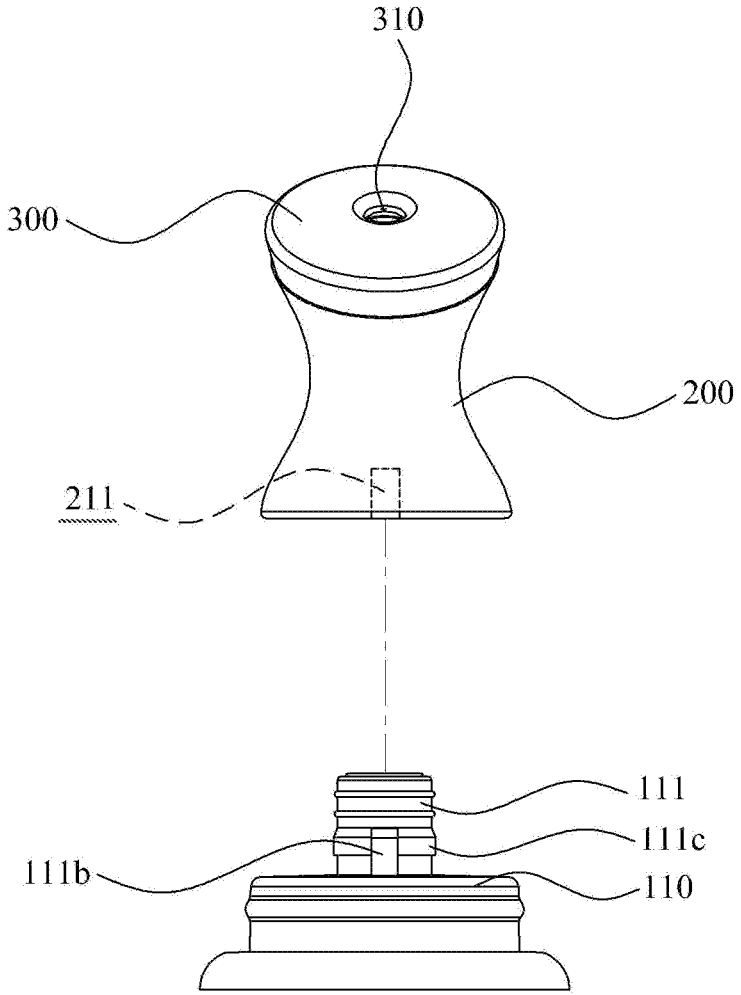
FIG. 5 is an explanatory view illustrating a combination of an outlet part and a support body of the tube container equipped with a metal applicator according to an exemplary embodiment of the present disclosure.

FIGS. 3 and 4 are cross-sectional views illustrating a configuration of a tube container equipped with a metal applicator according to an exemplary embodiment of the present disclosure. FIG. 5 is an explanatory view illustrating configuration of a part and a support body of a tube container equipped with a metal applicator according to an exemplary embodiment of the present disclosure.

Figure 6:
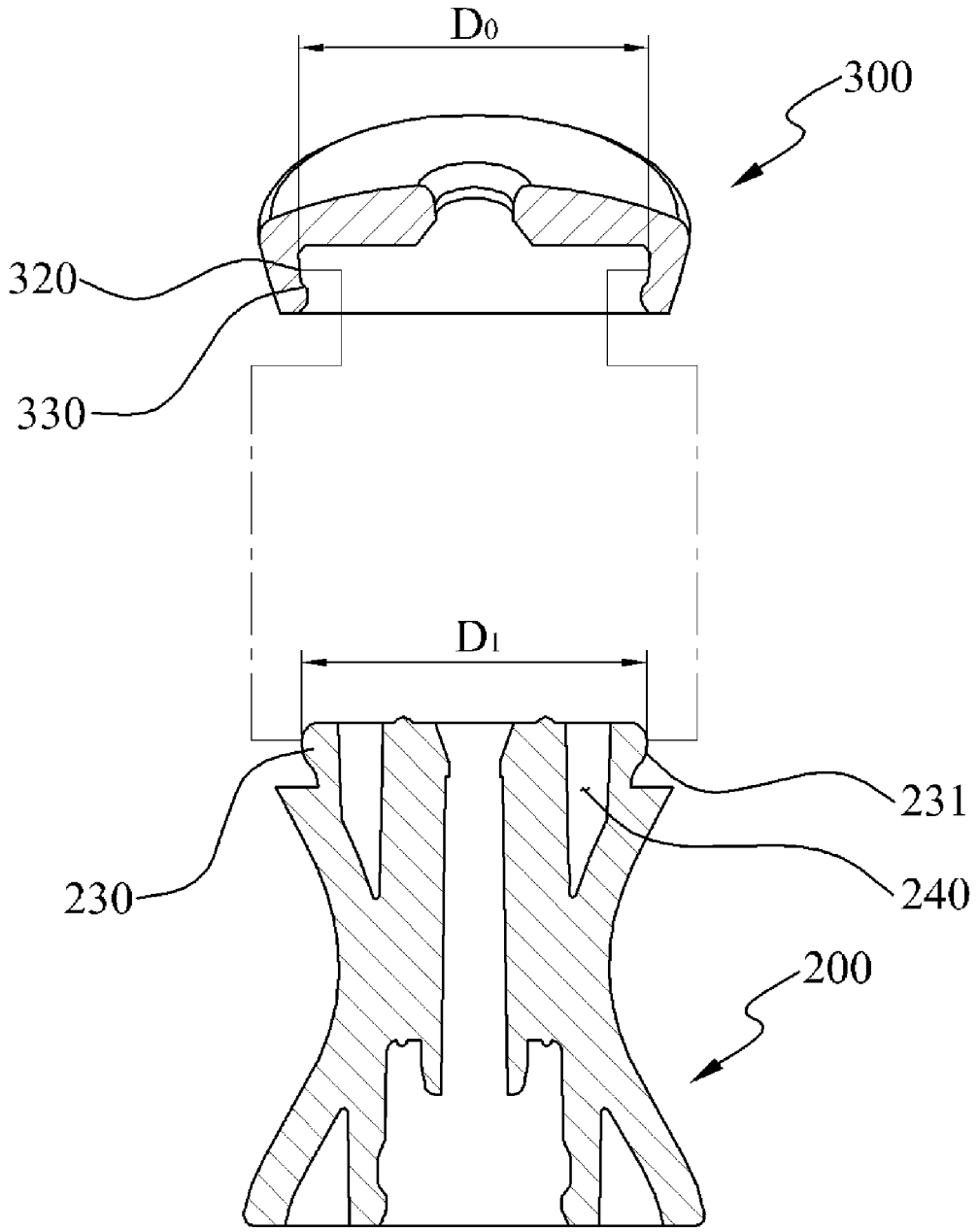
FIG. 6 is an explanatory view illustrating a size configuration of an applicator and a support body of the tube container equipped with a metal applicator according to an exemplary embodiment of the present disclosure.

FIG. 6 is an explanatory view illustrating a size configuration of an applicator and a support body of the tube container equipped with a metal applicator according to an exemplary embodiment of the present disclosure.

Referring to FIGS. 1 to 4, a tube container equipped with a metal applicator according to an exemplary embodiment of the present disclosure includes a tube body 100, a support body 200, an applicator 300, and an overcap 400.

Contents are contained into the container body (100), on whose upper portion a tube neck 110 having an outlet part 111 that discharges the contents is coupled, and on the center of the outlet part 111 is coupled a discharging hole 111*a* to which contents contained in the tube container body 100 is discharged.

Regarding to the presently described embodiments, on the lower outer circumferential surface of the outlet part 111 is formed a rotation preventing protrusion 111*b* which prevents a support body 200 from rotating, and the rotation preventing protrusion 111*b*, coupled with a coupling groove 211, prevents the support body 200 from rotating and simultaneously guides combining direction when coupling the support body 200 to the outlet part 111.

Meanwhile, it is preferred that a fixing protrusion 111*c* is formed, encircling the outer circumferential surface, on the outlet part 111 so as to prevent the support body 200 from being separated to upward direction after the support body 200 is coupled.

The support body 200, made of thermoplastic resin, supports an applicator 300, and comprises a passage where the contents discharged through the outlet part 111 flows, and further includes a fixing part 210, a contents movement tube 220, a coupling part 230, and a hollow part 240.

The fixing part 210 is coupled with the outlet portion on the inner lower portion of the support body 200 as encircling the outlet part 111 and fixes the support body 200 to the tube neck 110, wherein a coupling groove is built on the lower portion of the fixing part so as to be able to combine with the rotation preventing protrusion 111*b* and prevent the support body 200 from rotating.

Furthermore, on the inner lower portion of the fixing part 210 is formed a protrusion 212, which meets the lower end of the fixing protrusion 111*c* in a state of the protrusion 212 being combined with the outlet part 111 and prevents the support body 200 from moving upward.

The contents movement tube 220 is connected to the outlet part 111, and forms a passage longitudinally, so as to allow the contents discharged through the outlet part 111 to flow to the upper part.

The coupling part 230 is formed with protrusion on the upper end of the support body 200, coupled with an applicator 300 and supports the applicator 300, wherein a securing protrusion 231 is formed, as encircling the outer circumferential, so that the applicator 300 may be secured.

It is preferred that the securing protrusion 231 may have a fluent curve so that the applicator 300 can be attached and separated.

Meanwhile, the support body 200 has a narrow middle portion like an hourglass, wherein with the top end of the support body 200 forming a slope from one side to the other side, the applicator should be built obliquely, providing esthetic effect to the container.

Furthermore, as shown in FIGS. 3 and 4, it is preferred that a hollow part 240 is formed from the upper side and toward the lower side of the support body 200, so that when combined with elastic fit the support body 200 may be pressed, not only enabling to be contracted, but also effectively compensating by the elasticity the difference of the volume change that is caused by the temperature difference and temperature change of the applicator 300 and the support body 200, and thereupon the applicator 300 and the support body 200 are contacted tightly each other all the time and maintain their firmly contacted state.

The applicator 300 is coupled with a coupling protrusion 230 to be able to be attached and separated on the top end of the support body 200, and thereof on the center of the applicator 300, forms a contents discharging hole 310 which allows the contents to move through the contents movement tube 220 to the outside.

According to the present disclosure, the applicator 300 is made of metal, and thus it is possible to deliver heat or cold to the facial skin when applied, resulting in facilitating the metabolism of facial skin and improving the elasticity of the skin.

Furthermore, the applicator 300 is formed in a circular shape in the state of bilateral symmetry with the contents discharging hole 310 in the center, and thereby it is possible to mass-produce with ease through NC manufacturing process and also to reduce expense due to no need of a separate mold.

Furthermore, the applicator 300 can be manufactured through NC manufacturing process, so that it is possible not only to reduce the time required to grind and polish the applicator when post-processing but also to reduce post-processing expense.

Meanwhile, the support body 200 is made of thermoplastic resin and the applicator 300 is made of metal. In this case, since the embodiments of the present disclosure are usually used by contacting the applicator 300 directly to the facial skin after being warm or cool, the support body 200 and the applicator 300 are used under the condition of repeated temperature change.

In this case, the temperature change of metal and thermoplastic resin are varied in size; the coefficient of thermal expansion of metal has a range of 5-25 (unit: x0.000001/° C.), such as brass 18.7, copper 18.0, cast iron 10.8, stainless steel 14.4~'7.3, whereas the coefficient of thermal expansion of thermoplastic resin (polymer) is 50~600 (unit: x0.000001/° C.), such as polypropylene 100~200, polyethylene 200, polystyrene (PS) 70, because thermoplastic resin has weak secondary intermolecular bonds and minimum cross-links. In other words, under the conditions of the same temperature change, the size change of thermoplastic resin is bigger than that of metal, and thereby the difference of size change occurs.

Accordingly, the bonding structure between the support body 200 made of two kinds of material and the applicator 300 may get weaker or be separated, and also the gap between them may arise; thereby, undesirable results such as linkage of contents may occur. To prevent those problems, it is preferred that the outer radius (D1) of the coupling part 231 under the lowest usable temperature should be the same or bigger than the inner radius (D0) of the depression coupling part 320 under the ordinary usable temperature, as shown in FIG. 6.

That is, as described above, when the temperature rises, the support body 200 has bigger size increase according to the temperature change than the applicator 300 (in other words, when the outer radius (D1) of the coupling part 231 according to the temperature rise change gets bigger than the inner radius (D0) of the depression coupling part 320), leading the hollow part 240 to efficiently offset the difference of volume change by elasticity and then despite the temperature change and temperature difference, the applicator 300 and the support body 200 are able to contact each other and maintain combining state.

Meanwhile, when temperature drops, the reduction of the support body 200 is much bigger than that of the applicator 300, and whereupon, the space between the support body 200 and the applicator 300 should arise, and thereby bonding structure may become weaker or separation may occur.

Furthermore, when the applicator 300 touches a user's skin and is used, the applicator 300 having high coefficient of heat conduction gets to the temperature (this is called "ordinary usable temperature") of the user's skin with relatively rapid speed, and the size of the applicator increases rapidly, whereas the temperature rise of the support body 200 having low coefficient of heat conduction falls behind, and as a result, the size increase of the support body 200 is delayed, causing the gap between the support body 200 and the applicator 300 to arise, leading to the weakness of the bonding structure and the separation.

As shown in FIG. 6, these problems can be solved by setting the outer radius (D1) of the coupling part 231 under the lowest usable temperature (Generally, this is the temperature on which contents can be kept refrigerated without being deteriorated such as congelation.) to the same or bigger than the inner radius of the depression coupling part 320 under the ordinary usable temperature. Herein, the outer radius (D1) of the coupling part 231 and the inner radius (D0) of the depression coupling part 320 should be measured in the state where they are not coupled and separated respectively, and those measurements should be used.

In other words, when kept refrigerated under the lowest usable temperature, the outer radius (D1) of the coupling part 231 is set to be the same or bigger than the inner radius (D0) of the depression coupling part 320, and thus, always has a bigger measurement than that of the depression coupling part 320 under the same lowest usable temperature.

Meanwhile, while using, even when the applicator 300 rises in relatively rapid speed and the support body 200 is still under the lowest usable temperature, the outer radius (D1) of the coupling part 231 has the same or at least bigger measurement than the inner radius (D0) of the depression coupling part 320.

Hereforth, when both temperatures of the applicator 300 and the support body 200 rise above the lowest usable temperature, then again the outer radius (D1) of the coupling part 231 always gets to have bigger or at least the same measurement than the inner radius (D0) of the depression coupling part 320.

Accordingly, under any temperature change, the outer radius (D1) of the coupling part 231 is at least the same or bigger than the inner radius (D0) of the depression coupling part 320, and therefore, prevents the gap between the support body 200 and the applicator 300 from being generated, leading to preventing bonding structure from being weakened or separated, or fundamentally prevents the contents from being leaked.

Meanwhile, when the outer radius (D1) of the coupling part 231 is always bigger or has the same features (this means when the support body 200 and the applicator 300 are separated, meaning the same as previously described) than the inner radius (D0) of the depression coupling part 320, the support body 20 undergo an elastic deformation by the hollow part 240, with the support body 200 and the applicator 300 under the state of being coupled each other as shown in FIG. 3 or 4; thereby, the outer radius (D1) of the coupling part 231 is made to fit to the inner radius (D0) of the depression coupling part 320, and as a result, the support body 200 and the applicator 300 can be maintained in the state of being coupled tightly.

The overcap 400 encircles the support body 200 and the applicator 300 and is coupled to the tube neck 110, wherein an opening and closing projection 410 is provided with protrusion on the inner top of the overcap 400, so as to enable the contents discharging hole 310 to open and close.

As described above, optimal embodiments have been disclosed in the drawings and the specification. Although specific terms have been used herein, these are only intended to describe the present embodiments and are not intended to limit the meanings of the terms or to restrict the scope of the present embodiments as recited in the accompanying claims. Therefore, those skilled in the art will appreciate that various modifications and other equivalent embodiments are possible from the above embodiments. Therefore, the scope of the present disclosure should be defined by the technical spirit of the accompanying claims.

What is claimed is:

1. A tube container with a metal applicator comprising:

a tube body, wherein contents are held and a tube neck coupled with an outlet part is formed on an upper portion thereof, so that the contents may be discharged;

a support body, made of thermoplastic resin and coupled on the tube neck, comprising a passage wherein the contents move through the outlet part;

an applicator, made of metal, coupled on an upper end of the support body with elastic fit, and comprising a contents discharging hole, wherein the contents in a middle is discharged to the outside; and an overcap, coupled on the tube neck, while encircling the support body and the applicator, wherein an opening and closing projection which opens and closes the contents discharging hole is positioned, wherein the support body comprising:

a fixing part encircling the outlet part at an inner lower portion of the support body and engaged, thereby fixing the support body onto the tube neck;

a contents discharging tube connected to the outlet part and forming a passage wherein the contents discharged out through the outlet part flows;

a coupling part engaged on an upper end of the support body with protrusion and combined with the applicator, wherein a securing protrusion is formed, encircling an outer circumferential surface so that the applicator may be secured; and a hollow part formed from an upper portion of the support body towards a lower portion, wherein the applicator comprising:

a depression coupling part engaged on the lower portion of the applicator, with the securing protrusion inserted; and a coupling protrusion formed along an inner circumferential surface so that the securing protrusion may be caught at a lower portion of the depression coupling part, wherein an outer radius of the coupling part under a lowest usable temperature is the same or bigger than an inner radius of the depression coupling part under an ordinary usable temperature.

2. The tube container with a metal applicator of claim 1, wherein a rotation preventing protrusion is formed at a lower portion of an outer circumferential surface of the outlet part so as to couple with the support body and at the same time to prevent the rotation thereof.

3. The tube container with a metal applicator of claim 2, wherein a coupling groove is combined with the rotation preventing protrusion at a lower end of the fixing part.

4. The tube container with a metal applicator of claim 3, wherein a fixing protrusion is formed, encircling the outer circumferential surface, of the outlet part so as to prevent the support body from being separated; and a protrusion is formed at an inner lower portion of the fixing part confronting at an end of the fixing protrusion.

* * * * *